US005430996A

United States Patent [19]

Kurmis

[11] Patent Number: 5,430,996

[45] Date of Patent: Jul. 11, 1995

[54] SYSTEM FOR ARRANGING AND BINDING AN ELONGATED OBJECT, ESPECIALLY A CABLE HARNESS

[75] Inventor: Viktor Kurmis, Pinneberg, Germany

[73] Assignee: Paul Hellermann GmbH, Pinneberg, Germany

[21] Appl. No.: 140,115

[22] PCT Filed: May 6, 1992

[86] PCT No.: PCT/EP92/00988

§ 371 Date: Nov. 2, 1993

§ 102(e) Date: Nov. 2, 1993

[87] PCT Pub. No.: WO92/19501

PCT Pub. Date: Nov. 12, 1992

[30] Foreign Application Priority Data

May 7, 1991 [DE] Germany ..... 91 05 681.0

[51] Int. Cl.[6] ..... B65B 13/04

[52] U.S. Cl. ..... 53/589; 53/582; 29/755; 140/92.1

[58] Field of Search ..... 53/589, 592, 582; 100/25, 26, 30; 140/92.1, 93 R; 29/755

[56] References Cited

U.S. PATENT DOCUMENTS

| | | | |
|---|---|---|---|
| 3,250,209 | 5/1966 | Gage et al. | 100/26 |
| 3,956,982 | 5/1976 | Hill et al. | 53/589 X |
| 4,337,934 | 7/1982 | Caveney . | |
| 4,403,542 | 9/1983 | Lewis | 100/26 X |
| 4,407,107 | 10/1983 | Smith | 53/592 X |
| 4,561,234 | 12/1985 | Tonus . | |
| 4,561,349 | 12/1985 | Grenon | 53/589 X |

FOREIGN PATENT DOCUMENTS

| | | | |
|---|---|---|---|
| 1367018 | 6/1963 | France . | |
| 236434A1 | 6/1986 | Germany . | |
| 4035968 | 5/1991 | Germany | 100/26 |

*Primary Examiner*—Linda Johnson
*Attorney, Agent, or Firm*—Chilton, Alix & Van Kirk

[57] ABSTRACT

An arrangement for ordering and binding an elongated object, in particular a cable tree (4), comprises an ordering device (1) for example a laying board with supports for a cable tree, which determines the position of the object. It also comprises a binding device which binds the object with a tape (16). To this end, the binding device has a wrapping guide (2, 3) which wraps the tape around the object (4) and a sealing device (5) with a device (17) for joining the ends of the tape. The sealing device (5) can be moved relative to the ordering device (1) so that it can be placed at the various binding sites (18) in the object (4). According to the invention, at least part of the wrapping guide (2, 3, 20, 30) is arranged on the ordering device (1), i.e., at each of the binding sites (18). The sealing device (5) is therefore not attached to the binding device until it is placed on one of the wrapping guides (2, 3, 20, 30). To this end, the sealing device (5) and the wrapping guide (2, 3, 20, 30) are fitted with co-operating positioning devices (9, 11, 21, 28).

9 Claims, 5 Drawing Sheets

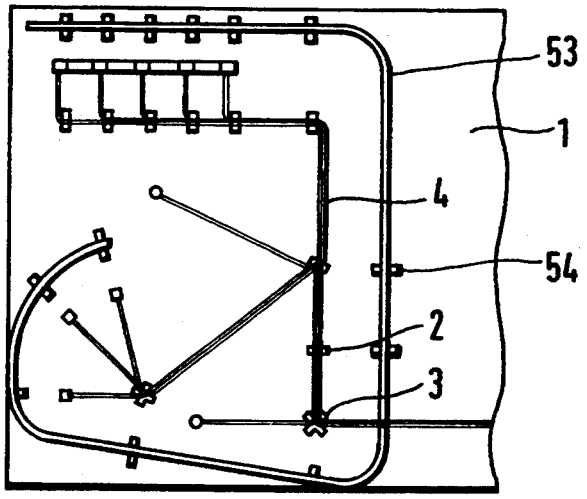
Fig. 1
Fig. 2
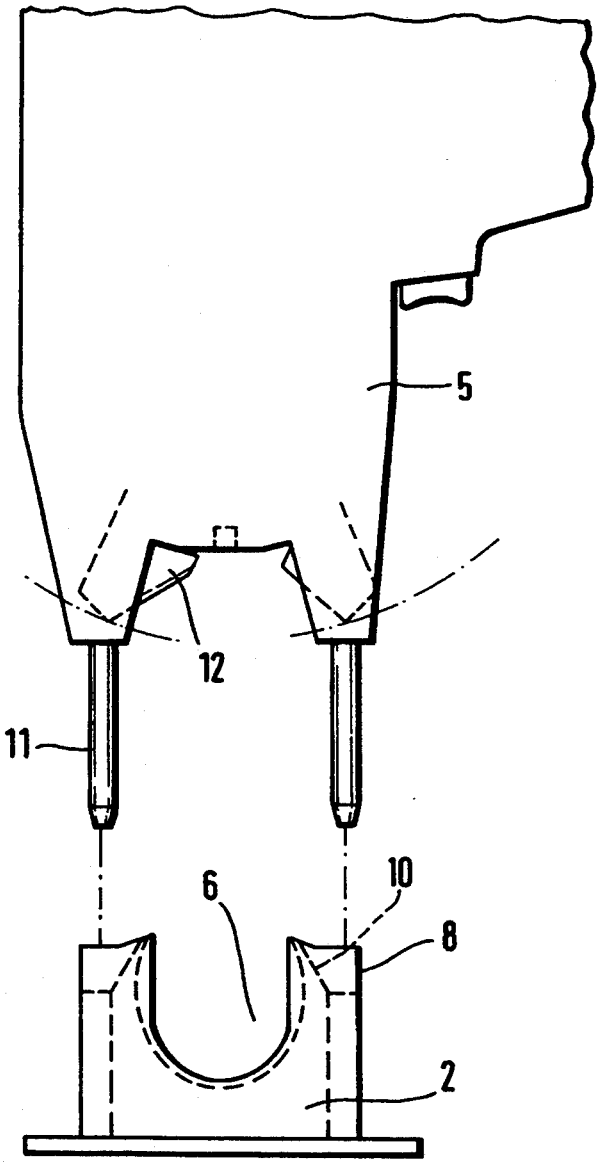

Fig. 10
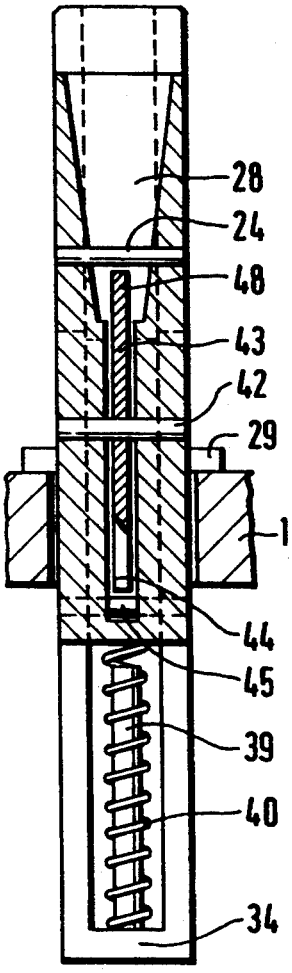
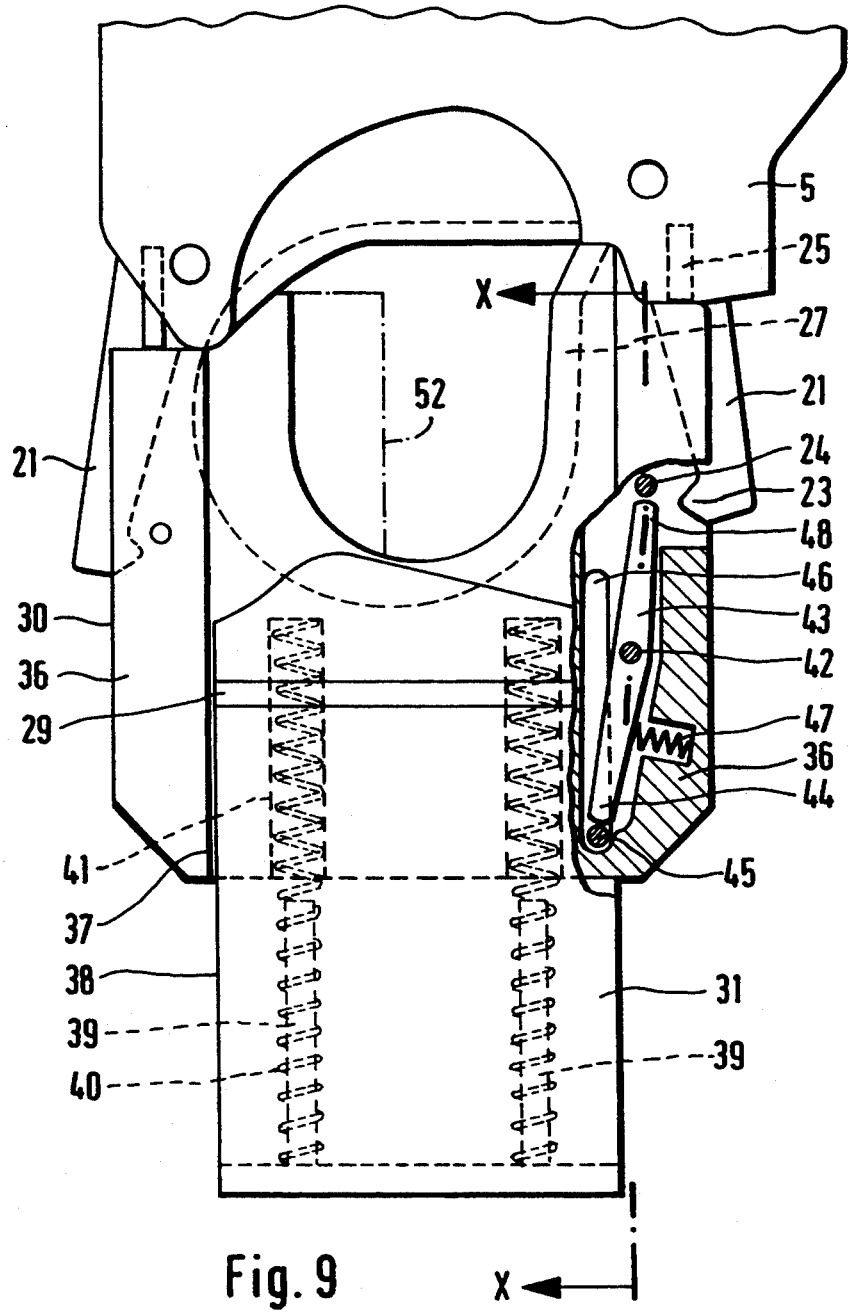
Fig. 9
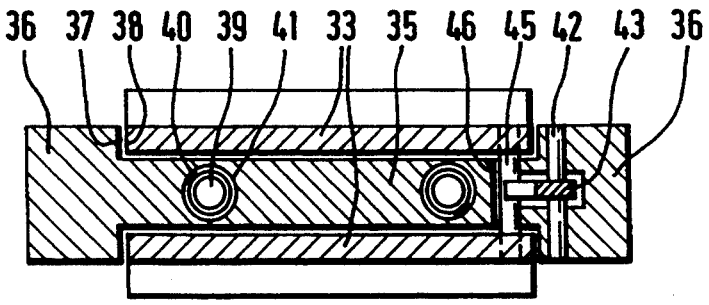
Fig. 11

SYSTEM FOR ARRANGING AND BINDING AN ELONGATED OBJECT, ESPECIALLY A CABLE HARNESS

The invention relates to a system for arranging and binding an elongated object, especially a cable harness. The system has an arranging device with whose aid the harness is arranged in a layer which is ready for binding. In the case of the cable harness, this arranging device is a layout table which has holders for constructing the desired structure of the cable harness, especially at bending points and junctions which are provided, and on which the cables are laid together. A further component of the system is a binding device for making loops around said harness and binding it by means of a lace, which device consists of a loop guide and a closing device. The loop guide guides the lace, emerging for example from a supply magazine, around the object and to the closing device, which contains apparatuses for connecting the lace ends. In the prior art, on the one hand the binding device forms an independent unit (U.S. Pat. No. 4,337,934) and, on the other hand, the loop guide and the closing device are combined in one tool (EP-A-0,264,142, DE-U-8,913,514, DE-U-9,004,993) which is sorted out by the arranging device. A normal embodiment of the loop guide is tongs which are disposed at the front end of a binding tool, are opened for gripping around and releasing the harness, are closed for carrying out the binding process and contain suitable guide devices for the lace. These known systems have the disadvantage that the reproducibility of the positioning of the tool relative to the object which is to be bound and is located in the arranging device is not guaranteed. Looking for suitable binding points is, rather, left to the operating personnel; the bindings thus turn out differently. When binding cable harnesses it is also possible for the abovementioned holders preferably to be disposed at the bending and junction points of the cable harness which are provided, thus not allowing the loop guide to surround the cable harness at these points. Using the known tools, no bindings can thus be made where they would secure the structure of a cable harness particularly effectively. A further disadvantage of the known tools is that the required opening and closing of the same in order to surround the object with the loop guide necessitate complex movement control.

The invention is based on the object of providing a system of the type mentioned initially, which does not have these disadvantages or has them only to a relatively minor extent.

The solution according to the invention has at least a part of the loop guide disposed on the arranging device. It is often adequate to dispose only a part of the apparatuses, which are used for guiding the lace on the arranging device, while other parts of the same are disposed on the tool. In the following text and in the claims, the term loop guide is thus intended also to mean parts of the complete lace guide apparatus, to the extent that they are disposed on the arranging device.

For harnessing a group of elongated objects at a single point by means of an adhesive strip, it is known (FR-A-1,367,018) for a lower holding device for the harness and an upper feed device for the adhesive strip to be disposed one above the other in a fixed spatial assignment, the holding device and the feed device each being equipped with one half of a rotating guide for the holding device. At the start of the binding process, the lower half of the rotating guide is raised with the holding device to the upper half of the rotating guide and to the adhesive strip feed device. In the rotating guide, which is combined in this way, the holding device is rotated with the harness, and the adhesive strip is at the same time looped around the harness. It is furthermore known, for harnessing a group of relatively short elongated objects at a single point (U.S. Pat. No. 4,561,234) to provide under a stationary binding tool a conveyor device on which a multiplicity of harness holders are arranged which are fitted with the harnesses in front of the tool, are held in the tool position for binding and are emptied behind the tool. Each harness holder has a loop guide in the form of a guide slot in which, in the tool position, an adhesive strip emerging from the tool is guided around the bundle and back to the tool again. Information on how a system could be designed which achieves a plurality of bindings on a single elongated object cannot be obtained from these known systems.

Since the position of the binding points is predetermined by the position of the loop guides on the arranging device, the points which are suitable for binding no longer need to be looked for, so that less qualified personnel can also operate the system without problems. Since the closing device is disposed separately from the loop guides before the actual binding process, there is spatial freedom in the region of the loop guides while the object is being prepared for binding, so that this process is simplified. There is no need for movement control for opening and closing the loop guide, so that the invention represents a considerable simplification of the system compared with the prior art. The construction of the loop guides as the part of the arranging device which influences the position of the object also allows, in particular, binding points to be provided at bends and junctions of cable harnesses. The separate closing device is not brought up until the object to be bound is finally positioned in the arranging device. The interacting positioning apparatuses thereon and the loop guide result in a position of the closing device which is always the same with respect to the object to be bound. The binding thus always takes place at precisely the desired point. Since, as a result of the positioning devices, it is not possible to exert tension or compression on the object by means of the closing device, and inclination of the same, maintenance of the intended binding tension is also guaranteed.

The preparation of the object for binding is frequently a long-lasting process in comparison with the binding itself. Thus, for example, the laying of cable harnesses lasts very much longer than the subsequent binding. It is then advantageous to provide only one closing device for a plurality of arranging devices.

An advantageous development of the invention is the disposition of the closing device on a guide device, which is constructed such that it can guide the closing device with respect to a plurality of loop guides. This guide device can be, for example, a guide rail or an industrial robot. Furthermore, guidance is possible via optoelectronic destination apparatuses which allow the closing device to approach the looping device more or less automatically.

If the closing device is not correctly coupled to the loop guide, the lace guiding devices of the loop guide are not correctly connected to the closing device so that incorrect binding can occur. According to the invention, this can be precluded by the drive of the closing device being constructed such that it can be released only when the closing device is coupled to the loop guide. If the closing device is pneumatically operated, the compressed-air feed to the compressed-air motor of the closing device can, for example, be passed via a channel which runs in the loop guide. It thus reaches the compressed-air motor only when the closing device and the loop guide are firmly connected to one another. In a corresponding manner, the power supply to an electrical drive can be passed via contacts which are disposed on the loop guide.

Another embodiment of this principle is for at least one probe to be disposed on the closing device, which probe confirms that the closing device is sufficiently close to the loop guide and it does not enable the release of the closing drive until then.

Incorrect binding can also occur if the closing device is prematurely released from the originally correct coupling position. According to a further feature of the invention, a locking apparatus can thus be provided for securing the coupling state, the control of the closing device being constructed such that the locking apparatus is closed before the start of the binding process and is not opened again until the binding process has been completed. The locking apparatus is preferably disposed on the closing device since the latter has drive means which can also be used for the locking apparatus.

In order to simplify the bringing up of the closing device to the loop guide, the interacting positioning apparatuses may have a large amount of play with one another in an insertion position, while they interact in a fitting manner in the final coupling position. They can be constructed as the locking apparatus.

The closing device as a rule has the property that it pulls the object to be bound against itself at the end of the closing process, when the lace is being pulled tight. If a stationary loop guide is used, this can lead either to the cable harness being deformed during the unbinding process or to it not being possible to tension the lace tightly around the cable harness, said lace however remaining loose. According to the invention, a remedy is created for this in that the loop guide is flexible, against spring force, in the opposite direction to that in which the cable harness would be raised during binding, if this flexibility were not present. This direction generally corresponds with that direction in which the closing device is brought up to the loop guide, and is generally the vertical direction. When the closing device is placed on the loop guide, the latter is pressed down by virtue of its flexibility until the closing device has reached the cable harness, so that the binding of the cable harness can take place without the latter having to move closer to the closing device.

If the closing device is at the same time the holder for shaping the cable harness, the flexibility may be disruptive during laying of the cable harness. According to a further feature of the invention, it is therefore provided that a block is provided for blocking the lowering function in the non-lowered position, which block can be released by the closing device, which is coupled to the loop guide.

The invention is explained in more detail in the following text, making reference to the exemplary embodiment shown in the drawing, in which:

FIG. 1 shows a plan view of a layout table for laying a cable harness, having the loop guides disposed thereon;

FIG. 2 shows a side view of the closing device and of the loop guide;

FIG. 9 shows a side view of a third embodiment, in which the loop guide is disposed in a flexible manner;

FIG. 10 shows a sectional view along the dashed dotted line X in FIG. 9;

FIG. 11 shows a horizontal section through the loop guide according to FIG. 9, a little above the pin 42.

Reference is made to FIG. 1. Disposed on an arranging device, which is a layout table 1 in the exemplary embodiment, are a number of loop guides 2, 3 which also form holders for the cable harness 4 which is to be formed and into which the cables are inserted during assembly of the cable harness 4. Their spatial distribution on the layout table 1 corresponds to the desired shape of the cable harness 4.

Figure 3:
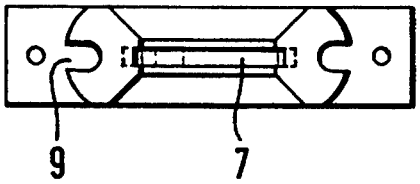
FIG. 3 shows a plan view of the loop guide according to FIG. 2.
Figure 4:
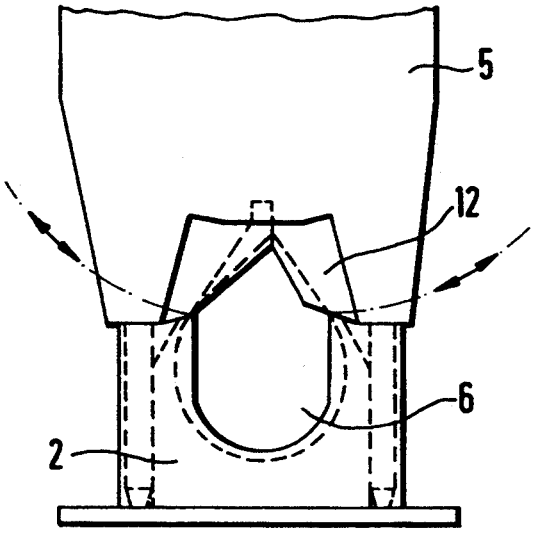
FIG. 4 shows an illustration, corresponding to FIG. 2, with the closing device placed on the loop guide.

FIG. 2 shows a closing device 5 having a loop guide 2, which is additionally illustrated in plan view in FIG. 3. The loop guide 2 has a U-shaped recess 6 whose edges hold the cable harness. A lace guide slot 7 is provided in the edges and the base of the recess 6 in such a manner that a lace can be guided in the guide slot along one edge downwards, over to the other side in the base, and back upwards again in the other edge, thus looping around the cable harness which is inserted into the recess 6 without said cable harness impeding its movement. On two outer sides 8 of the loop guide 2 there are positioning slots 9 which have conical expansions 10 upwards. Provided on the underneath of the closing device 5 are two parallel positioning pins 11 whose disposition corresponds to the positioning slots 9. When the closing device 5 is brought up to the loop guide 2, the positioning pins 11 engage in the positioning slots 9 and thus produce the correct position of the closing device with respect to the loop guide 2 and a position of the closing device 5, which is predetermined by the position of the loop guide 2 and is then always the same, with respect to the cable harness 4 to be bound. The conical expansions 10 simplify the insertion of the positioning pins 11 into the positioning slots 9. The closing device 5 has two lace guide flaps 12. FIG. 4 shows that, when the closing device 5 and loop guide 2 are in the joined state, the loop guide flaps 12 together with the U-shaped recess 6 of the loop guide 2 form a closed lace guide. A lace which emerges downwards from the closing device at the start of the binding process is thus initially passed through a guide slot in one of the lace guide flaps 12 to the guide slot 7 in one edge of the loop guide, around the cable harness 4 and thereafter back in the other lace guide flap.

Figure 5:
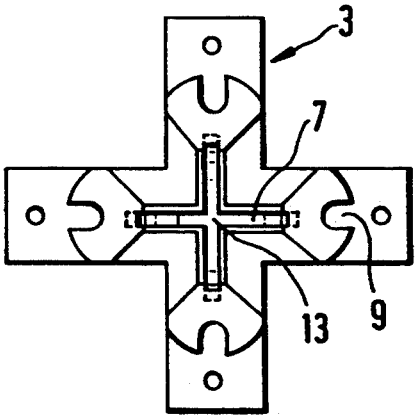
FIG. 5 shows a plan view of a loop guide for two mutually crossing bindings.

In order to fit two bindings which cross one another, for example at crossing or junction points of the cable harness 4, the loop guide 3 which is shown in FIG. 5 is provided, which is assembled from two loop guides, which cross one another at right angles, of the type shown in FIG. 3. It has two U-shaped recesses 6 whose paths cross one another at right angles and in which there are lace guide slots 7, which likewise cross one another at right angles. The loop guide 3 has four positioning slots 9 which are disposed in the same manner as in the case of the loop guide 2 and likewise have conical expansions upwards. The cables of the cable harness 4 are inserted into the loop guide 3 such that the crossing or junction point of the cable harness 4 lies at the point of intersection 13 of the lace guide slots 7. Subsequently, two bindings which cross another can be fitted by placing the closing device 5 on twice, rotated through 90° in each case.

FIG. 1 indicates schematically a rail 53 having holding points 54 on which the closing device is guided along the row of binding points 2, 3 and can in each case be stopped in order to produce a binding. The binding process can thus be further simplified, and possibly automated.

Figure 7:
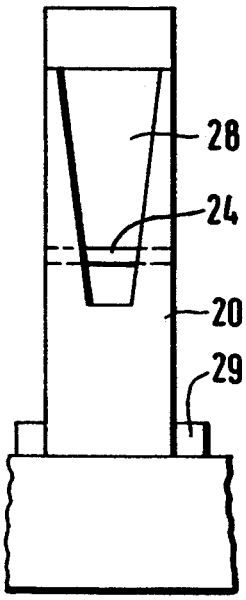
FIGS. 7 and 8 show an end view and a plan view of the loop guide in the embodiment shown in FIG. 6.
Figure 6:
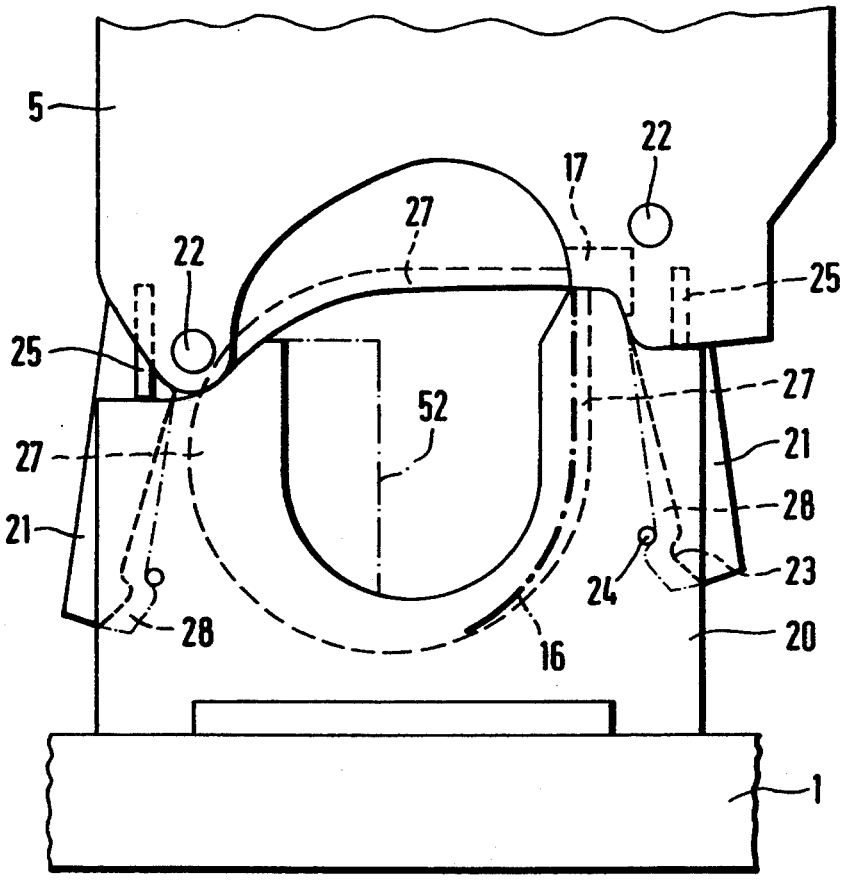
FIG. 6 shows a side view of a second embodiment.
Figure 8:
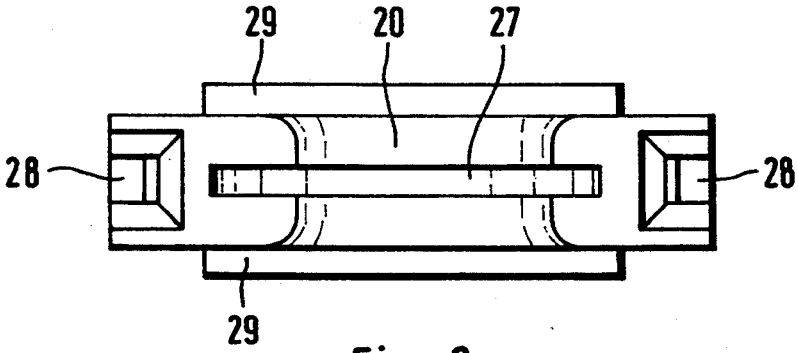

In the second embodiment, which is illustrated in FIGS. 6–8, of the invention, instead of the pins 11, which were explained in the first embodiment, the closing device 5 has positioning wedges 21 which project downwards in an elongated manner and taper from top to bottom in end view. Correspondingly wedge-shaped recesses 28 are provided in the corresponding ends of the loop guide 20. Since these recesses become wider at the top and the wedges 21 become narrower at the bottom, they can easily be inserted into one another from above. In the coupling position, they fit tightly in one another and thus lead to the closing device being centred with respect to the loop guide.

The positioning wedges 21 can pivot about pins 22 in order that they can be pivoted out of the position which is illustrated in FIG. 6 and is slightly spread into the position which is illustrated by dashed-dotted lines in the same figure. They have an inwardly pointing tab 23 which, in the inwardly pivoted state, engages under a pin 24, which is firmly disposed in the loop guide 20 and runs transversely, in order firmly to lock the closing device 5 on the loop guide 20. The pivoting of the wedges 21 into the locking position takes place as the first phase of the closing process and is brought about by the drive and control devices which are provided in the closing device 5. They are then not released again until the closing process has been completed, and thus ensure the correct coupling state is maintained between the closing device 5 and the loop guide 20, throughout the entire binding process.

In order to initiate the binding process, two probes 25 are provided on the closing device, which respond when the closing device 5 has reached its coupling position with respect to the loop guide 20. They emit a signal which initiates the binding process or releases a block which prevents the initiation of the binding process before then.

As soon as the binding process has been initiated, a lace 16 is pushed out of a magazine, which is contained in the closing device 5, in such a manner that its front end is pushed into the guide slot 27 in the loop guide. Once the tip of the lace has passed through the complete circle of the guide slot 27, it penetrates into the apparatus 17 for connecting the two lace ends, from where the lace is subsequently tensioned and the ends are connected to one another. This is described in more detail in the following text, making reference to FIGS. 9 and 12.

The loop guide 20 has attachment feet 29 which can be screwed on the layout board 1.

The third embodiment, which is illustrated in FIGS. 9–12, is identical to that according to FIGS. 6–8, the extent not mentioned below. The essential additional feature is that the loop guide 30 can be lowered against spring force. A housing 31, which holds the loop guide 30, is screwed via attachment feet 29 to the layout panel 1. The housing comprises two mutually parallel housing panels 33 which are firmly and rigidly connected to one another at the lower end, by means of a web 34. Guided between them is the centre panel 35 of the loop guide which, in horizontal section, merges at the ends into two thickened parts 36 in which the recesses 28, which were described above, for holding the positioning wedges 21 are formed. The thickened parts 36 form guide edges 37 which interact with the side edges 38 of the housing panels 33 in order to guide the loop guide 30 in a movement direction which is vertical with respect to the layout table 1.

The web 34 of the housing 31 carries two pins 39 which run parallel to the guidance direction and are used for holding and guiding in each case one helical compression spring 40 whose upper end is located in holes 41, which are coaxial with respect to the pins 39, in the loop guide 30. These springs press the loop guide into the uppermost position, which is illustrated in FIG. 9. The loop guide can be pressed downwards against their effect in order to move into the position according to FIG. 12. The layout table 1 has a cut-out in which the housing 31 is mounted and the thickened ends 36 of the loop guide are located.

Supported within the loop guide 30 about a horizontal, stationary pin 42 is a blocking lever 43 which is acted on in the clockwise direction by means of a spring 47 so that its lower end 44 engages between the housing panels 33. The latter contain a pin 45 in this region. In order that this pin does not impede the vertical movement of the loop guide, the latter contains a vertical slit 46 in which the pin 45 moves during the vertical movement of the loop guide. In the raised position of the loop guide, the pin 45 is located just below the lower end 44 of the blocking lever 43. In this position, which is illustrated in FIG. 9, the blocking lever blocks the lowering movement of the loop guide.

In this position, the upper end 48 of the blocking lever 43 is located in that region underneath the pin 24 into which the tab 23 of the positioning wedge 21 penetrates during locking of the closing device on the loop guide. During the inwardly directed movement of this tab, the upper lever end 48 is thus displaced inwards, as a result of which the blocking lever 43 is pivoted in the anticlockwise direction and its lower end 44 leaves the location above the pin 45. This releases the lowering movement of the loop guide.

Figure 12:
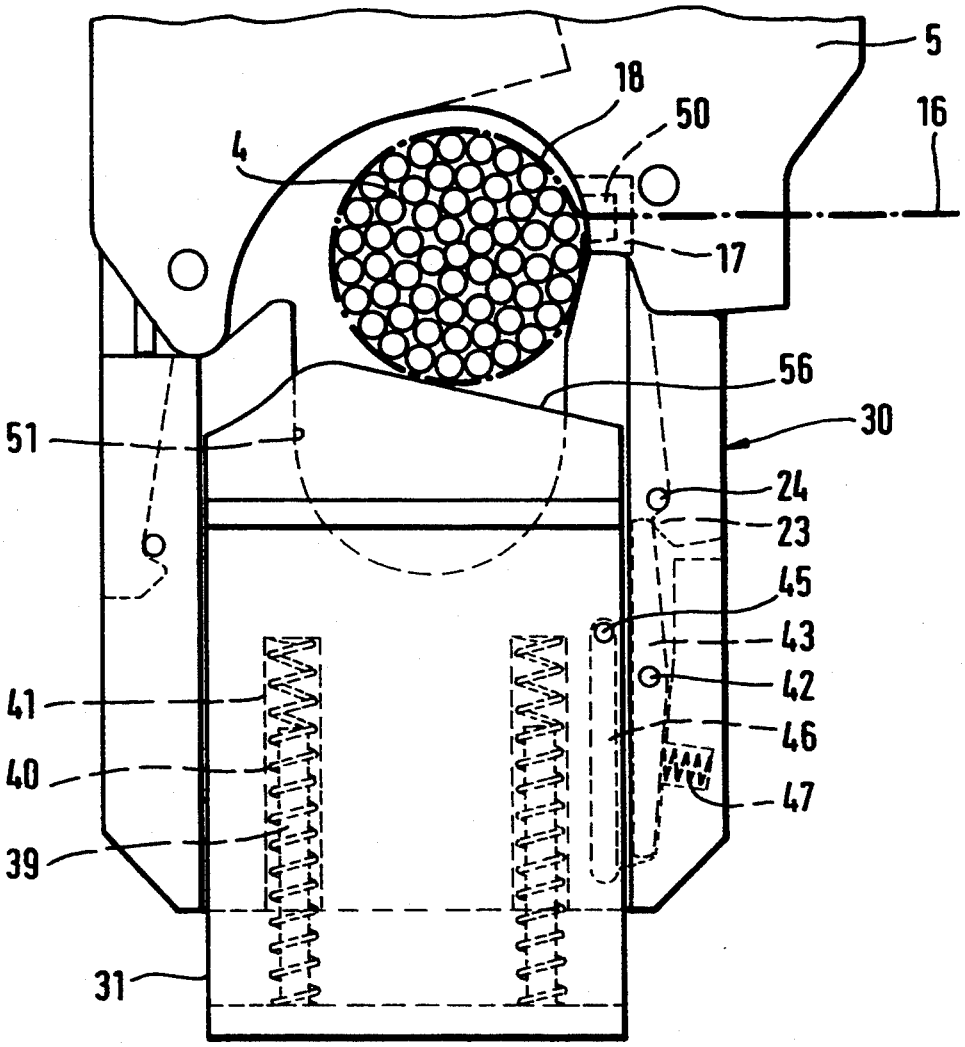
FIG. 12 shows a side view of the embodiment shown in FIG. 9, with the cable harness inserted and the loop guide lowered.

FIG. 12 illustrates the state of the device at the end of the closing process. The positioning wedges 21 are located in the locking position, in which the tab 23 has rotated the blocking lever 43 into the neutral position. The loop guide 30 is lowered. The cable harness is located in the upper region of the recess 6 in the loop guide and can be supported by the upper edge 56 of the housing 31. The lace 16 is looped around the cable harness 4 as the binding 18. The lace ends are connected to one another in the apparatus 17 for binding the lace ends, by the free lace end being passed through a lace lock 50. The cable harness 4 is also raised, by the tension of the binding 18, with respect to the recess 6 in the loop guide, to the level of the apparatus 17; or the loop guide 30 is lowered in a corresponding manner.

After the binding process, as soon as the loop guide has moved back to its uppermost position again from the lowered position and the closing device 5 has been removed, the blocking 1ever 43 returns to the position illustrated in FIG. 9.

For the looping and binding function, the shape of the recess 6 of the loop guide does not need to be specially matched to any of the dimensions of the cable harness. However, if it is also intended to be used as a holder for positioning the cable harness during its production, it is expedient if it corresponds to the dimensions of the cable harness. While the left-hand edge 51 of the recess 6 of the loop guide corresponds approximately to the dimensions of the cable harness 4 illustrated, in the case of a thinner cable harness it should be located further to the right in the illustration in FIGS. 6 and 9, as is indicated by dashed-dotted lines 52 in FIG. 9.

We claim:

1. In a shaped cable harness retention and binding apparatus comprising a plurality of harness supports mounted on an arranging base and a closing device movable between the harness supports for mounting thereon and for performing a binding wherein the harness supports include loop guides and alignment means, and the closing device includes complementary alignment means that cooperate with the alignment means on the harness support for alignably positioning the closing device on the individual harness supports, the combination wherein one of the harness supports and the closing device is provided with a latch abutment member and the other of the harness supports and the closing device is provided with latching means movable into latching engagement with the latch abutment member, and a control device is provided for effecting release of the latching means upon completion of a binding operation.

2. The apparatus according to claim 1, wherein a guide device is provided for guiding the closing device from one harness support to the next.

3. The apparatus according to claim 1, wherein the loop guide has lace guide slots running crosswise.

4. The apparatus according to claim 1 wherein the latching means is responsive to the control device to effect latching engagement before the initiation of the binding operation.

5. The apparatus according to claim 1 wherein the control device includes a probe responsive to movement of the latching means into latching engagement for signaling the initiation of the binding operation.

6. The apparatus according to claim 1 wherein the latching means includes a tab mounted on the alignment means for latching engagement with the latch abutment member.

7. The apparatus according to claim 1 wherein the harness support is movable between a rest position and a retracted position and is biased toward its rest position, said closing device being effective to drive the harness support out of its rest position toward its retracted position.

8. The apparatus according to claim 1 wherein the harness support is movable between a rest position and a retracted position and includes releasable blocking means for preventing movement out of its rest position.

9. The apparatus according to claim 8 wherein said blocking means includes a movable lever biased into a blocking position, said latching means being effective to drive said lever out of the blocking position upon movement into said latching engagement.

* * * * *

UNITED STATES PATENT AND TRADEMARK OFFICE

CERTIFICATE OF CORRECTION

PATENT NO. : 5,430,996
DATED : July 11, 1995
INVENTOR(S) : Viktor KURMIS

It is certified that error appears in the above-indentified patent and that said Letters Patent is hereby corrected as shown below:

Col.7, line 25, Claim 1, after "binding", insert -- operation --.

Signed and Sealed this

First Day of October, 1996

*Attest:*

Bruce Lehman

BRUCE LEHMAN

*Attesting Officer*

*Commissioner of Patents and Trademarks*